US009931685B2

(12) United States Patent
Broggi et al.

(10) Patent No.: US 9,931,685 B2
(45) Date of Patent: Apr. 3, 2018

(54) TUBE BENDING MACHINE WITH AN AUTOMATIC LOADING SYSTEM AND METHOD FOR AUTOMATIC LOADING OF TUBES ON THE BENDING HEAD OF A TUBE BENDING MACHINE

(71) Applicant: BLM S.p.A., Cantu', Como (IT)

(72) Inventors: Mauro Broggi, Como (IT); Paolo Bramati, Monza e Brianza (IT); Cesare Moscatelli, Como (IT)

(73) Assignee: BLM S.p.A., Cantu', Como (IT)

( * ) Notice: Subject to any disclaimer, the term of this patent is extended or adjusted under 35 U.S.C. 154(b) by 0 days.

(21) Appl. No.: 15/261,097

(22) Filed: Sep. 9, 2016

(65) Prior Publication Data

US 2016/0375481 A1 Dec. 29, 2016

Related U.S. Application Data

(62) Division of application No. 13/154,024, filed on Jun. 6, 2011, now abandoned.

(30) Foreign Application Priority Data

Jun. 10, 2010 (IT) ..... TO2010A0491

(51) Int. Cl.
*B21D 43/00* (2006.01)
*B21D 7/12* (2006.01)

(52) U.S. Cl.
CPC ..... *B21D 43/006* (2013.01); *B21D 7/12* (2013.01)

(58) Field of Classification Search
CPC ..... B21D 7/02; B21D 7/021; B21D 7/024; B21D 7/025; B21D 43/006; B21D 7/12; B21D 5/004; B21D 26/039; B21D 43/021; B21D 43/022; B21D 43/02; G05B 2219/36203; G05B 2219/35192;
(Continued)

(56) References Cited

U.S. PATENT DOCUMENTS 4,311,031 A 1/1982 Schwarze
4,388,039 A 6/1983 Schwarze
(Continued)

FOREIGN PATENT DOCUMENTS

WO 01/91936 A1 12/2001

OTHER PUBLICATIONS

Extended European Search Report for corresponding European Patent Application No. 11169126.7 dated Nov. 21, 2011.

*Primary Examiner* — R. K. Arundale
*Assistant Examiner* — Mohammad Yusuf
(74) *Attorney, Agent, or Firm* — Merchant & Gould P.C.

(57) ABSTRACT

The machine includes: a bending head movable with at least two degrees of freedom in a transverse vertical plane; a first drive is arranged to move the bending head in the plane and to move a tool of the bending head between an open position, in which it defines with a die of the bending head a free space adapted to receive a tube to be bent, and a closed position, in which it clamps the tube against the die. A tube-carrying structure is rotatable about an axis of rotation perpendicular to the plane; a second drive is arranged to cause the tube-carrying structure to rotate about its own axis of rotation; and an electronic control unit is arranged to control the first and second drives so as to move the bending head and the tube-carrying structure in a position such that the tube is received with a desired orientation in the free space between the die and the tool.

2 Claims, 4 Drawing Sheets

(58) Field of Classification Search
CPC ..... G05B 2219/37403; G05B 2219/45143; G05B 2219/45137; B23Q 3/064; B23Q 5/22
USPC ..... 72/149
See application file for complete search history.

(56) References Cited

U.S. PATENT DOCUMENTS

| | | | |
|---|---|---|---|
| 5,901,596 | A | 5/1999 | Tetzloff et al. |
| 5,927,126 | A | 7/1999 | Biella |
| 6,434,993 | B1 | 8/2002 | Broggi et al. |
| 6,694,794 | B2 | 2/2004 | Crippa |
| 7,104,100 | B2 | 9/2006 | Saegusa |
| 7,254,972 | B1 | 8/2007 | Wang |
| 2006/0065034 | A1 | 3/2006 | Yogo |

TUBE BENDING MACHINE WITH AN AUTOMATIC LOADING SYSTEM AND METHOD FOR AUTOMATIC LOADING OF TUBES ON THE BENDING HEAD OF A TUBE BENDING MACHINE

This application is a Divisional of U.S. patent application Ser. No. 13/154,024, filed 6 Jun. 2011, which claims benefit of Serial No. TO2010A000491, filed 10 Jun. 2010 in Italy and which applications are incorporated herein by reference. To the extent appropriate, a claim of priority is made to each of the above disclosed applications.

BACKGROUND OF THE INVENTION

The present invention relates to a tube bending machine comprising a bending head and an automatic loading system arranged to load a tube to be bent on the bending head. According to a further aspect, the present invention relates to a method for automatic loading of tubes on the bending head of a tube bending machine.

The term "tube" used in the following description and claims is to be intended as referring also to any other elongated blank, such as a bar or a profiled section. Likewise, the term "tube bending machine" is to be intended as referring also to a machine arranged to bend any other elongated blank, such as a bar or a profiled section.

Different kinds of automatic loading systems for tube bending machines are available on the market and in their simplest and cheapest form basically consist of an inclined plane on which the tube to be bent is caused to slide, the inclined plane being provided with stop members to stop the tube to be bent. The tube bending machines provided with such automatic loading systems are able to take a tube positioned on the inclined plane and to put down the worked tube on the ground by suitable control of the machine axes. In these tube bending machines, the position of the tube on the inclined plane is known in a transverse vertical plane (i.e. in a vertical plane perpendicular to the tube feed direction, or longitudinal direction), whereby the control unit of the machine is able to determine, on the base of suitable geometrical parameters of the machine, of the tube and of the inclined plane, the exact point where to position a loading tool (which may be either the bending tool normally present on the bending head of the machine or a tool specially designed for this purpose) to take the tube from the inclined plane. The tube is then made available to the bending head in an initial position, for instance the stop position at the bottom of the inclined plane defined by the aforesaid stop members, and is then moved by the bending head directly from this initial position to a final position where it can be clamped by a tube clamp or similar clamping member carried by the machine body. The automatic loading systems for tube bending machines currently available work well with tubes of circular cross-section, but not so well with tubes of non-circular cross-section. In case of tubes of non-circular cross-section, there is in fact the problem of properly orienting the tube relative to the loading tool in order to avoid damages to the tube resulting from the tube being clamped with a wrong orientation between the jaws of the loading tool or between the bending tool and the die. In order to avoid this problem, the automatic loading systems currently available on the market require a specific loading tool which can be oriented manually or a specific loading fixture designed so as to have exactly the same angle as the one existing between the loading tool and the axis of the tube to be loaded, which obviously involves problems in terms of time and costs for setting and mounting.

SUMMARY OF THE INVENTION

It is therefore an object of the present invention to allow the automatic loading also of tubes with a non-circular shape on the bending head of a tube bending machine.

This and other objects are fully achieved according to a first aspect of the present invention by virtue of a tube bending machine and, according to a further aspect of the present invention, by virtue of a method for automatic loading of tubes on the bending head of a tube bending machine.

Advantageous embodiments of the invention form the subject-matter, the content of which is to be intended as integral and integrating part of the following description.

In short, the invention is based on the idea of providing a tube bending machine comprising:

- a bending head which is movable with at least two degrees of freedom in a transverse vertical plane (i.e. in a vertical plane perpendicular to the tube feed direction), the bending head being provided with a clamping fixture adapted to take an open position, in which it defines a free space for insertion of a tube, and a closed position, in which it clamps the tube previously inserted into this free space;
- first driving means arranged to move the bending head in the transverse vertical plane and to move the clamping fixture between the above-mentioned open and closed positions;
- a tube-carrying structure rotatably mounted about an axis of rotation perpendicular to the transverse vertical plane;
- second driving means arranged to cause the tube-carrying structure to rotate about its own axis of rotation between an initial position, in which the tube-carrying structure is able to receive the tube, and a final position; and
- an electronic control unit arranged to calculate an initial position of the bending head and to calculate the above-mentioned final position of the tube-carrying structure in such a manner that with the bending head in the calculated initial position and with the tube-carrying structure in the calculated final position the tube carried by the tube-carrying structure is arranged with the desired orientation, relative to the clamping fixture of the bending head, in the free space defined by this fixture, and to control said first and second driving means so as to move the bending head in the transverse vertical plane until it reaches the respective calculated initial position, so as to cause the tube-carrying structure to rotate about its own axis of rotation from the respective initial position to the respective calculated final position, and so as to cause the clamping fixture to clamp the tube once the bending head and the tube-carrying structure are in the calculated initial position and in the calculated final position, respectively.

With the geometrical parameters of the machine, of the loading system and of the tube being known, the electronic control unit of the tube bending machine is able to define each time the path of the bending head in the transverse vertical plane and the rotation of the tube-carrying structure about its own axis of rotation, and hence to control the relating driving means accordingly, whereby with the bending head in the respective calculated initial position and with the tube-carrying structure in the respective calculated final position the tube carried by the tube-carrying structure is arranged in the free space of the clamping fixture of the bending head with the desired orientation relative to the clamping fixture and can therefore be correctly clamped by this latter. Unlike the prior art, the tube is not therefore directly moved by means of the bending head from the initial position to the final position on board of the machine, but is first moved by means of the tube-carrying structure from the initial position into an intermediate position (corresponding to the calculated final position of the tube-carrying structure and to the calculated initial position of the bending head) and then moved by means of the bending head from the intermediate position to the final position on board of the machine. Whereas the initial and final positions of the tube are fixed, the intermediate position is established from time to time by the electronic control unit.

With a loading system according to the invention, special tools or additional loading fixtures are no more required to ensure the desired orientation of the tube. Moreover, the tube can be automatically loaded either with tube bending machines able to perform both right-hand (i.e. in clockwise direction) and left-hand (i.e. in counter-clockwise direction) bending or with tube bending machines able to perform only one type of bending, i.e. only right-hand bending or only left-hand bending.

Preferably, the clamping fixture is formed by the die and by the bending tool already present on the bending head. There is therefore no need to use an additional clamping fixture.

Preferably, the two degrees of freedom of the bending head in the transverse vertical plane are a translational degree of freedom along a horizontal direction and a rotational degree of freedom about an axis perpendicular to the transverse vertical plane.

Preferably, the tube-carrying structure is spaced from the bending head in a direction perpendicular to the transverse vertical plane, thereby allowing the bending head to move freely in that plane with no risk of collisions with said structure. In this connection, the tube-carrying structure is provided with a feeding device arranged to move the tube carried by the tube-carrying structure towards the bending head, so as to allow the bending head to take the tube carried by the tube-carrying structure when this latter is in the calculated final position.

BRIEF DESCRIPTION OF THE DRAWINGS

Further features and advantages of the present invention will appear more clearly from the following detailed description, given purely by way of non-limiting example with reference to the appended drawings, in which.

DETAILED DESCRIPTION OF THE PREFERRED EMBODIMENTS

Figure 1:
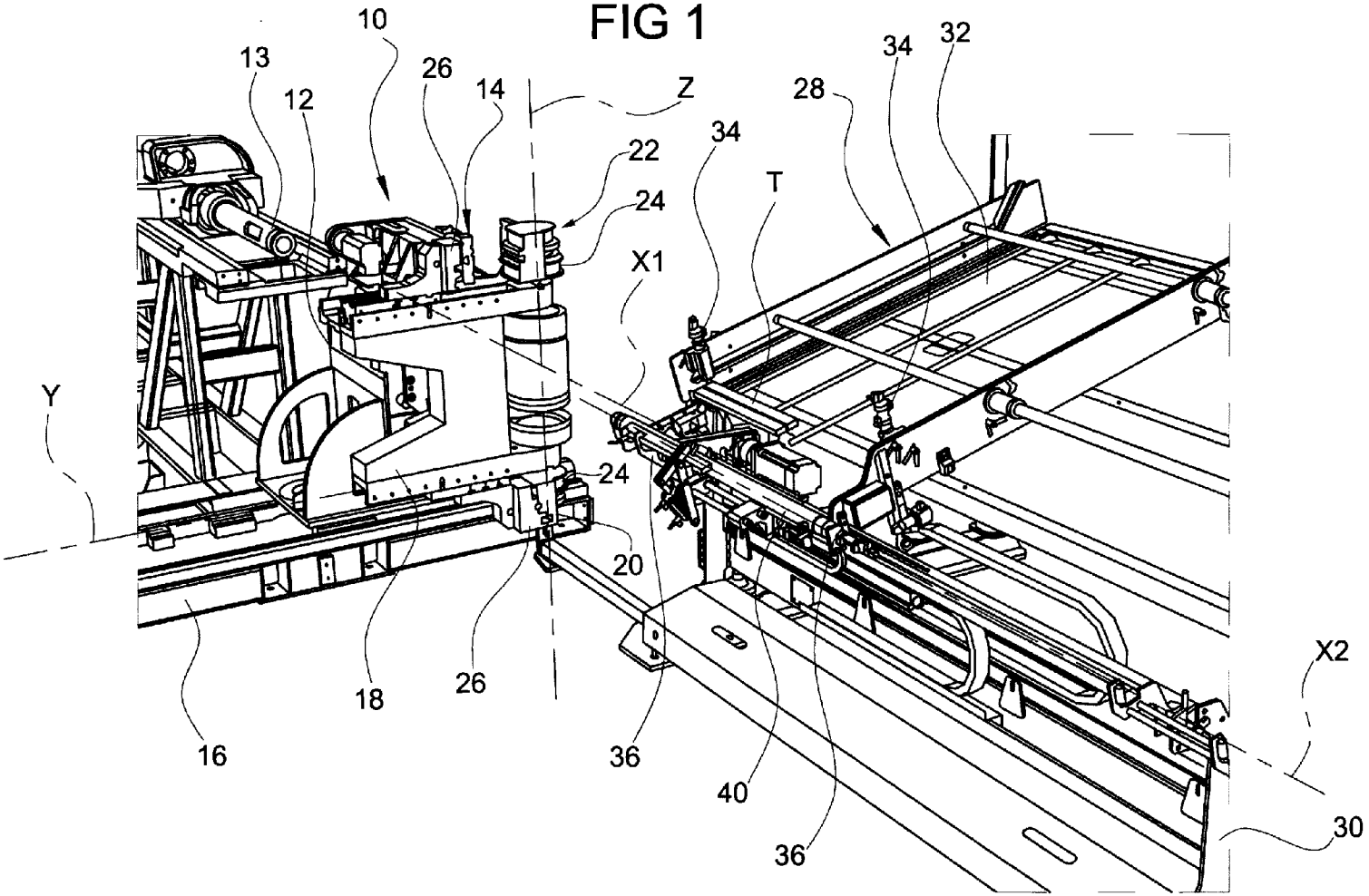
FIG. 1 is a perspective view which shows a tube bending machine provided with an automatic loading system according to a preferred embodiment of the present invention.
Figure 3:
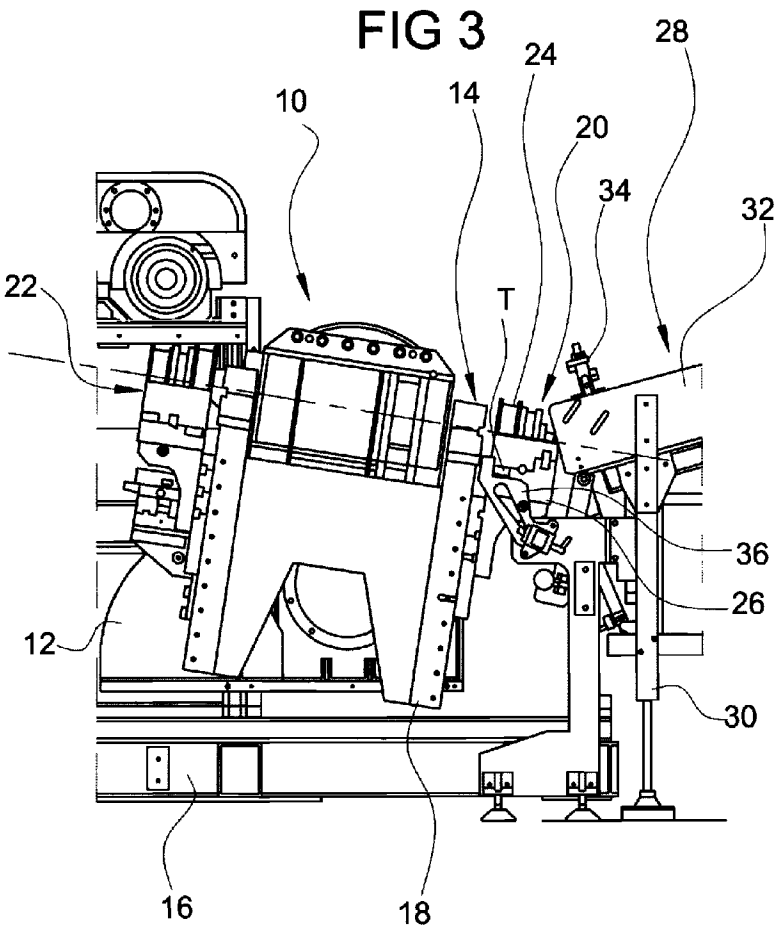
FIGS. 2 and 3 are front elevation views which show on an enlarged scale the tube bending machine of FIG. 1 in the intermediate position taken by the tube during the loading phase, in the case of left-hand bending and in the case of right-hand bending, respectively.
Figure 2:
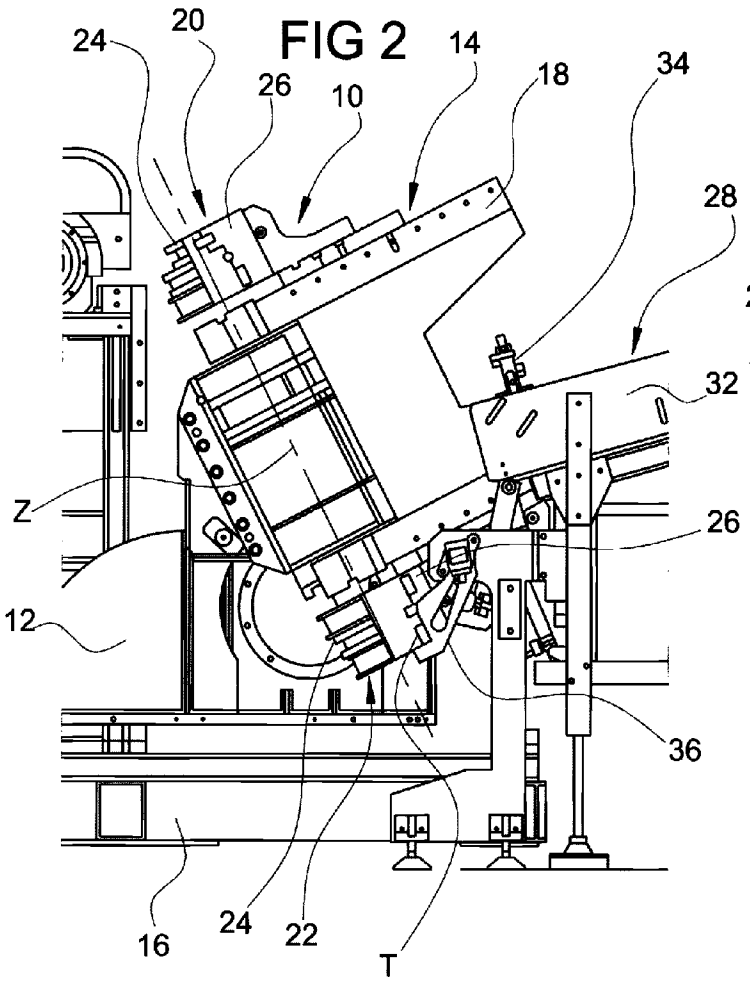

With reference first to FIGS. 1 to 3, numeral 10 generally indicates a tube bending machine which in the present case is able to perform both right-hand bending and left-hand bending, but which could also be a tube bending machine able to perform only one of these two kinds of bending. The tube bending machine 10 is substantially of per-se-known type. Therefore, it will not be described in detail with reference to all its the parts, but only those parts which are of some interest for the present invention will be cited and described. The tube bending machine 10 basically comprises a body 12, on which a tube clamp 13 is arranged, and a bending head 14 supported by the body 12. The bending head 14 is movable with at least two degrees of freedom in a transverse vertical plane, that is to say, in a vertical plane perpendicular to the tube feed direction (or longitudinal direction). In the present case, the bending head 14 is rotatably supported by the body 12 about an axis of rotation X1 parallel to the above-mentioned longitudinal direction (i.e. an axis perpendicular to the transverse vertical plane). Moreover, the body 12 is slidably supported by a base 16 of the tube bending machine 10 so as to translate along a horizontal direction Y perpendicular to the axis of rotation X1 (i.e. a direction laying in the transverse vertical plane). In the present case, the two degrees of freedom of the bending head 14 are the rotation of the bending head 14 about the axis of rotation X1 and the translation of the body 12, and of the bending head 14 therewith, in the direction Y. It is however clear that other kinds of movement of the bending head 14 able to provide at least two degrees of freedom in the transverse vertical plane can be conceived. For instance, the bending head 14 could be moved in two perpendicular directions laying in the transverse vertical plane. A bending arm 18 is rotatably mounted on the bending head 14 about an axis of rotation Z perpendicular to the axis of rotation X1. The bending arm 18 carries, on diametrically opposite sides of the axis of rotation X1, a first bending fixture 20 arranged to perform right-hand bending and a second bending fixture 22 arranged to perform left-hand bending. Each bending fixture 20, 22 comprises a die 24 which is rotatable about the same axis of rotation as that of the bending arm 18 (axis of rotation Z) and a tool 26 which is slidably mounted on the bending arm 18 along a direction passing through this axis and perpendicular thereto so as to be movable between an open position (or loading/unloading position), in which a tube T to be worked can be inserted into the space between the die 24 and the tool 26 or a worked tube T can be ejected from that space, and a closed position (or working position), in which a tube T to be worked is clamped by the tool 26 against the die 24. The following description will refer to the case in which the die 24 and the tool 26 of the bending fixture are used as clamping fixture for loading the tube on the bending head, but the invention can clearly be applied equally well to the case of a tube bending machine the bending head of which is provided with an additional clamping fixture, which is separate from the bending fixture and comprises for instance a pair of clamping jaws movable with respect to each other between an open position, in which they define a free space for insertion of a tube, and a closed position, in which they clamp the tube previously inserted into that space.

The tube bending machine 10 is also provided with first driving means arranged to move the above-mentioned parts of the machine, and therefore to move in particular the bending head 14 in the transverse vertical plane by controlling both the rotation of the bending head 14 about the axis of rotation X1 and the translation of the body 12 along the direction Y, as well as with an electronic control unit arranged to control said first driving means according to suitable programmable operating logics. Both the first driving means and the electronic control unit are of per-se-known type and will not therefore be described in further detail.

Again with reference to FIGS. 1 to 3, the tube bending machine 10 further comprises a loading device, generally indicated 28. The loading device 28 is arranged on a side of the machine, with respect to a vertical plane passing through the axis of the tube clamp 13 (tube feed direction). In the illustrated example, the loading device 28 is arranged on the left-hand side of the tube bending machine 10 (with respect to the tube feed direction), but could also be arranged on the opposite side of the machine. Moreover, the loading device 28 is advantageously spaced from the bending head 14 in the longitudinal direction, i.e. in a direction perpendicular to the transverse vertical plane, so as to avoid the risk of contact of the bending head against the loading device during its movement in the transverse vertical plane. In per-se-known manner, the loading device 28 comprises a support frame 30 and an inclined plane 32 supported by the support frame 30 and having an inclination such as to allow a tube T placed thereon to move down by gravity close to the bending head 14 of the tube bending machine 10. The loading device 28 is provided with stop members 34 for stopping the tube T at the bottom of the inclined plane 32.

According to the invention, the tube bending machine 10 further comprises a tube-carrying structure 36 arranged to receive each time a tube T from the loading device 28 (in the illustrated example, arranged to receive each time a tube T at the bottom of the inclined plane 32) and to move it towards the bending head 14 of the tube bending machine 10 by causing it to rotate about an axis of rotation X2 perpendicular to the transverse vertical plane (hence, in the present case, an axis of rotation parallel to the axis of rotation X1 of the bending head 14), so as to place it in a position such that it can be taken by the bending head 14. In the illustrated example, the tube-carrying structure 36 consists of at least two arms or levers rotatably supported by the support frame 30 about the axis of rotation X2. Each arm has, in a free end portion thereof (i.e. in a portion opposite to the portion in which the arm is hinged to the support frame 30), a seat 38 adapted to receive a tube T and a locking member (not shown as it is of per-se-known type) movable between an open position, in which the tube T can be inserted into the seat 38 and drawn out from it, and a closed position, in which the tube is locked inside the seat. The seat 38 is defined for instance by a pair of straight sides arranged at a right angle.

The tube-carrying structure 36 is preferably provided with a cylinder 40 (FIG. 1) arranged to urge the tube T in the longitudinal direction towards the bending head 14 so as to allow clamping of the tube by the clamping fixture carried by the bending head. Instead of a cylinder, any other kind of linear actuating device adapted to cause the tube T to move towards the bending head 14 might of course be used.

The loading device 28 provided with the inclined plane 32 might also be replaced by any other kind of device adapted to put each time a tube T to be bent on the tube-carrying structure 36. The loading device might even be omitted, in which case the operation of putting the tube to be bent on the tube-carrying structure would be performed manually by an operator.

Second driving means (of per-se-known type and hence not described in further detail) are associated to the tube-carrying structure 36 and are arranged to cause the tube-carrying structure to rotate about the axis of rotation X2 between an initial position, in which the tube-carrying structure is able to receive a tube T, and a final position, and to move the locking members of the tube-carrying structure between the above-mentioned open and closed positions.

Also the second driving means (associated to the tube-carrying structure 36), beyond the first driving means (associated to the body 12 and to the bending head 14 of the tube bending machine 10), are controlled by the electronic control unit of the tube bending machine. In this connection, according to the invention the electronic control unit of the tube bending machine 10 is arranged to calculate, on the base of suitable geometrical parameters of the machine itself, of the tube-carrying structure 36, of the loading device 28 (if any) and of the tube T to be worked, the final position of the tube-carrying structure 36 and an initial position of the bending head 14 in the transverse vertical plane such that with the tube-carrying structure 36 in said final position and with the bending head 14 in said initial position the tube T carried by the tube-carrying structure 36 is placed in the free space defined by the clamping fixture of the bending head 14 (in the illustrated embodiment, the free space existing between the tool 26 and the die 24), with the clamping fixture in the open position, and can then be locked by the clamping fixture to be taken by the bending head 14 and brought by this latter in a final position on board of the machine to be clamped here by the tube clamp 13. The movements of the bending head 14 and of the tube-carrying structure 36 are calculated by the electronic control unit of the tube bending machine 10 so as to ensure that the tube T is positioned in the free space defined by the clamping fixture (free space between the die 24 and the tool 26) with the desired orientation, and can then be clamped between these two components of the clamping fixture with no risk of being damaged. In this connection, the expression "desired orientation" is to be intended, in view of the present invention, as referring to an orientation of the tube-carrying structure 36 (and hence of the tube T carried by it) relative to the bending head 14 in the transverse vertical plane such that the profile of the cross-section of the tube T forms a given angle with the profiles of the contact surfaces of the two components of the clamping fixture (the die 24 and the tool 26, in case of use of the bending fixture as clamping fixture, or the clamping jaws, in case of use of an additional clamping fixture). Once the movements to be imparted to the bending head 14 and to the tube-carrying structure 36 have been calculated, the electronic control unit suitably controls the first and second driving means in order to obtain the desired movements. The movement of the bending head 14 and the movement of the tube-carrying structure 36 can take place either in sequence (first the movement of the bending head 14 and then the movement of the tube-carrying structure 36 or vice versa) or at least partially simultaneously.

Figure 4:
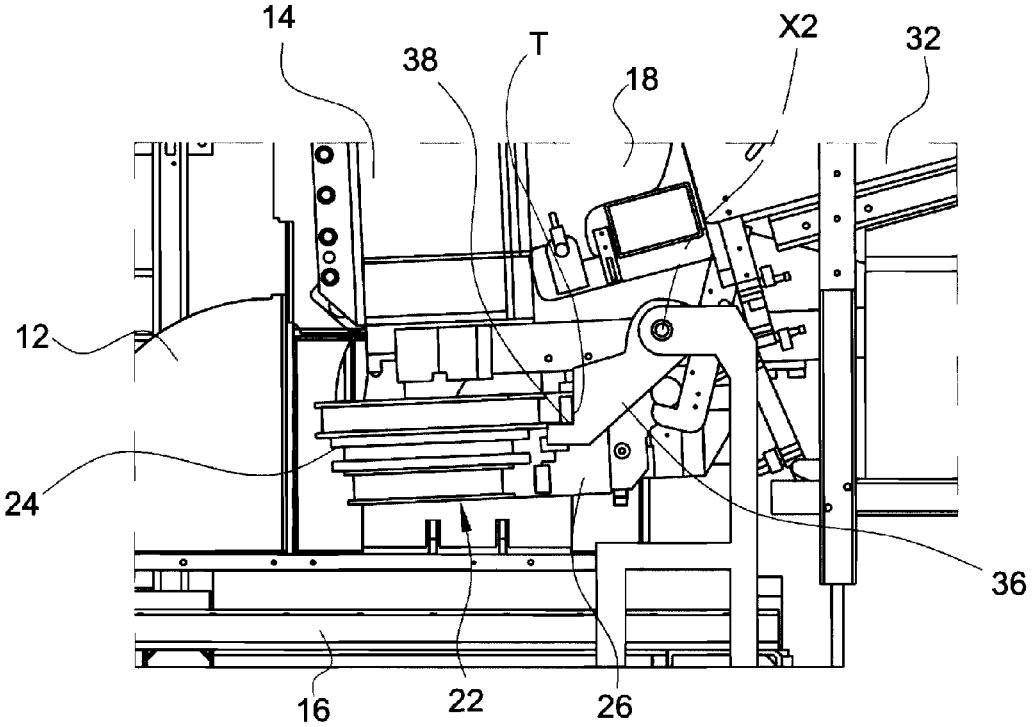
FIGS. 4 and 5 are front elevation views which show on a further enlarged scale the tube bending machine of FIG. 1 in the intermediate position taken by a tube of rectangular cross-section during the loading phase, in case of a so-called "upright bending", i.e. a bending with the main axis of the rectangular cross-section of the tube parallel to the bending axis (axis of the die of the bending head) and in case of a so-called "laid down bending", with the main axis of the rectangular cross-section of the tube perpendicular to the bending axis, respectively.
Figure 5:
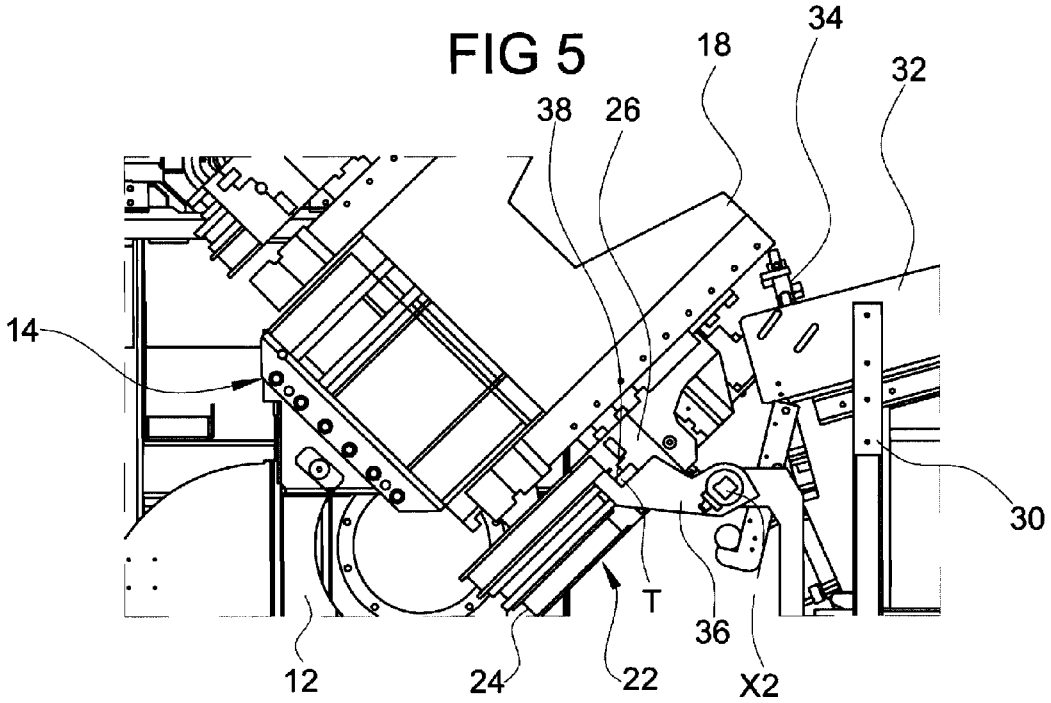

A tube bending machine provided with an automatic loading system according to the present invention allows therefore to place each time a tube to be bent with the desired orientation on the bending head, irrespective of the shape of the cross-section of the tube and without requiring the use of special tools or loading fixtures. In this connection, FIGS. 2 and 3 show how the invention allows to load a tube T on the bending head 14 of the tube bending machine 10 both in the right-hand bending configuration, in which case the tube T is put down between the die 24 and the tool 26 of the first bending fixture 20 (FIG. 3), and in the left-hand bending configuration, in which case the tube T is put down between the die 24 and the tool 26 of the second bending fixture 22 (FIG. 2). Moreover, as can be seen in FIGS. 4 and 5, in case of a tube T of rectangular cross-section the tube can be loaded automatically on the bending head 14, with no need of special tools or loading fixtures, both in the so-called "upright bending" configuration (FIG. 4) and in the "laid down bending" configuration (FIG. 5).

Figure 6:
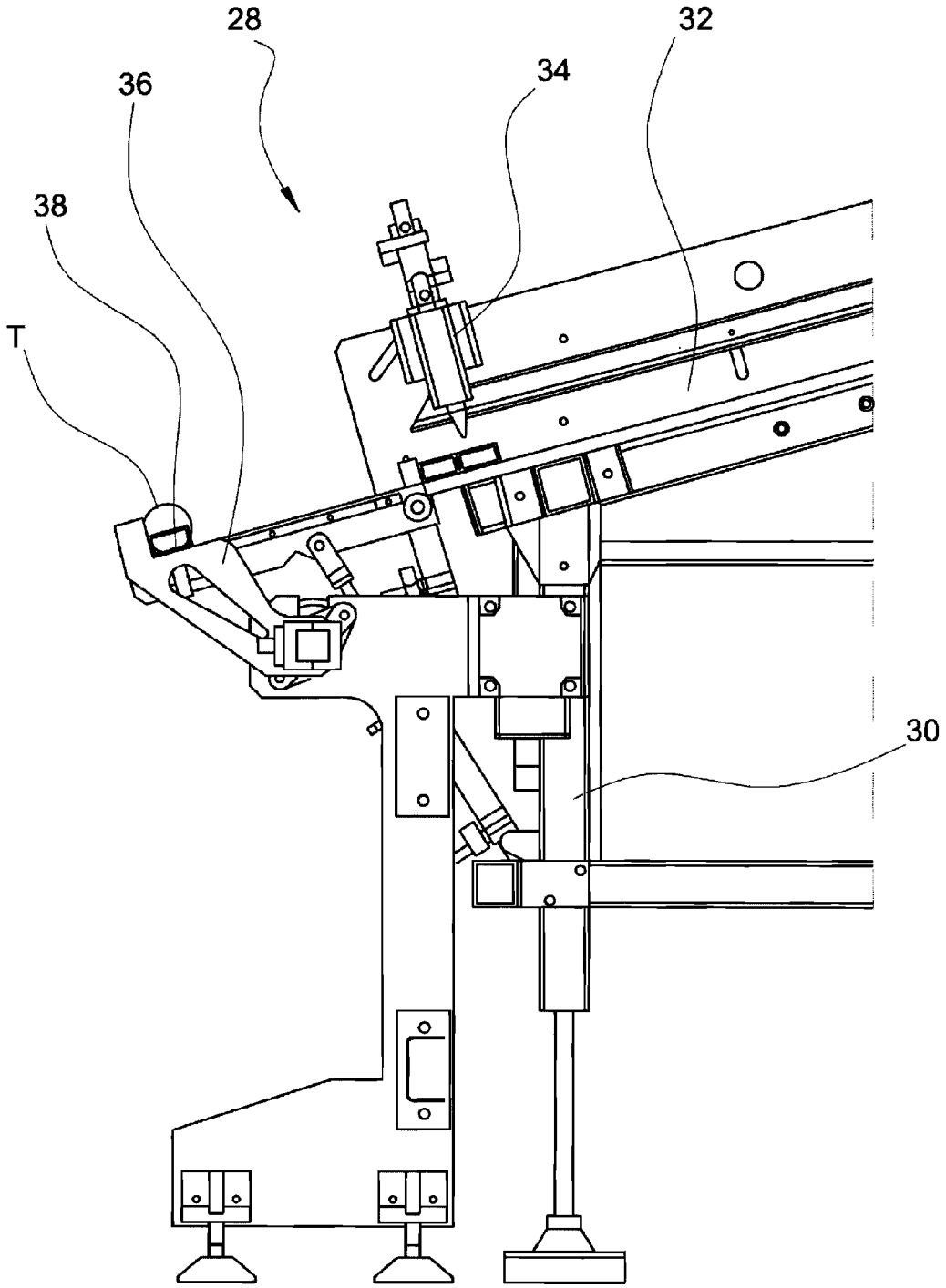
FIG. 6 is a front elevation view which shows on an enlarged scale the tube-carrying structure of the tube bending machine of FIG. 1 in the initial position, with a tube of circular cross-section loaded thereon.

Finally, FIG. 6 shows the use of the tube-carrying structure 36 for loading a tube T having a circular cross-section, and in particular the arrangement of the tube in abutment against the two perpendicular straight sides of the seat 38 of each of the arms of the tube-carrying structure. The tube-carrying structure 36 is shown in FIG. 6 in the initial position in which it is arranged in such a manner that the seats 38 face towards the inclined plane 32 of the loading device 28 and the tube T can therefore slide down by gravity in the seats 38 upon release of the stop members 34 which lock the tube T at the bottom of the inclined plane. Starting from this initial position, the second driving means cause the tube-carrying structure 36 to rotate by a given angle, which is suitably calculated by the electronic control unit of the tube bending machine 10, until the tube reaches the respective final position (for instance the position shown in FIGS. 2 to 4), calculated in such a manner that the tube T is placed between the die 24 and the tool 26 of the bending head 14 and can therefore be clamped there between. In case of a tube of circular cross-section, the invention advantageously allows to take into account the orientation of holes, welding beads or other workings which may be present on the tube.

The automatic loading of a tube T on the bending head 14 of the tube bending machine 10 is therefore carried out with the following steps:

- the tube-carrying structure 36 is positioned in the initial position so as to be ready to receive a tube T in the respective seats 38, the tube being for instance stopped by means of the stop members 34 at the bottom of the inclined plane 32 of the loading device 28;
- the stop members 34 at the bottom of the inclined plane 32 of the loading device 28 are released so as to cause the tube T to fall, or better to slide down, into the seats 38 of the tube-carrying structure, or alternatively the tube T is loaded manually on the tube-carrying structure 36;
- the tube T is locked in the seats 38 of the tube-carrying structure 36 by means of the locking members of this latter;
- the electronic control unit of the tube bending machine 10 calculates the final position of the tube-carrying structure 36 and the initial position of the bending head 14 such that the tube T is placed with the desired orientation in the free space between the die 24 and the tool 26 of the bending fixture 20 or 22 (depending on the machine having to perform a right-hand bending or a left-hand bending, respectively) of the bending head 14 and can therefore be clamped between the die and the tool;
- the second driving means are operated so as to cause the tube-carrying structure 36 to rotate about the axis of rotation X2 until it reaches the final position calculated by the electronic control unit;
- the tube T is moved towards the bending head 14, for instance by means of the cylinder 40;
- the first driving means are operated so as to move the bending head 14 in the transverse vertical plane until it reaches the initial position calculated by the electronic control unit;
- the tube T is clamped between the die 24 and the tool 26 of the bending fixture 20 or 22 of the bending head 14;
- the locking members of the tube-carrying structure 36 are brought back into the open position so as to allow the tube T to leave the seats 38;
- the tube-carrying structure 36 is brought back into the initial position or, in any case, into a non-operative position such as to avoid contact with the bending head 14 during the bending of the tube T; and
- the bending head 14 is moved by the first driving means into a final position in which it allows the tube clamp 13 to clamp the tube T in order to allow the bending operation to start.

The loading of the tube comprises therefore a first step in which the tube is moved, by rotation of the tube-carrying structure about its own axis of rotation from the respective initial position to the respective final position calculated by the electronic control unit, from the respective initial position (for instance the stop position at the bottom of the inclined plane, if any) to a respective intermediate position, and a second step in which the tube is moved by means of the bending head from the respective intermediate position to a respective final position to be clamped by the tube clamp.

In the light of the above description, the advantages which can be obtained with a tube bending machine provided with an automatic loading system according to the present invention are evident.

First of all, the tube to be bent can be positioned on the bending head of the tube bending machine with the desired orientation with no need to add a special tool or loading fixture. The invention allows to load automatically a tube both on a machine able to perform both types of bending, i.e. right-hand bending and left-hand bending, and on a machine able to perform only one type of bending. In case of a tube of rectangular cross-section, the tube can be loaded automatically to be bent both in the "upright bending" configuration and in the "laid down bending" configuration, also with no need of a special tool or loading fixture. The invention allows to take into account automatically, by calculating in advance the movements of the tube-carrying structure and of the bending head, possible changes in the geometrical parameters of the bending head, of the tube-carrying structure and/or of the tube to be loaded, as well as possible changes in the orientation of holes or welding beads present on the tube to be loaded.

Naturally, the principle of the invention remaining unchanged, the embodiments and the constructional details may vary widely with respect to those described and illustrated purely by way of non-limiting example.

What is claimed is:

1. A method for automatically loading a tube or a similar elongated blank on a tube bending machine, wherein the tube is initially carried by a loading device arranged on a side of the tube bending machine with respect to a vertical plane passing through a tube feed axis defined by a tube clamp of the tube bending machine; the method comprising the steps of:

a) removing the tube from the loading device by a tube-carrying structure, the tube-carrying structure being rotatable about an axis of rotation parallel to said tube feed axis;

b) rotating the tube-carrying structure about said axis of rotation to position the tube in an intermediate position;

c) moving a bending head of the tube bending machine with two degrees of freedom in a transverse vertical plane perpendicular to said tube feed axis until the bending head reaches a position such that the tube is placed within a clamping fixture of the bending head, said intermediate position being previously determined such that the tube is positioned with a desired orientation with respect to the clamping fixture of the bending head;

d) clamping the tube by the clamping fixture of the bending head with the tube in said intermediate position;

e) disengaging the tube from the tube-carrying structure;

f) moving the tube by the bending head to a final position such that a longitudinal axis of the tube is aligned with said tube feed axis; and g) clamping the tube by the tube clamp.

2. The method according to claim 1, further comprising:

between steps b) and c), the step of urging the tube towards the bending head and, between steps e) and f), the step of moving the tube-carrying structure away from the bending head in a position such that the tube-carrying structure does not interfere with the bending head.

* * * * *